US010671021B2

(12) United States Patent
Winkler et al.

(10) Patent No.: US 10,671,021 B2
(45) Date of Patent: Jun. 2, 2020

(54) MECHANICAL TIMEPIECE MOVEMENT WITH A RESONATOR HAVING TWO DEGREES OF FREEDOM WITH A MAINTAINING MECHANISM USING A RUNNER ROLLING ON A TRACK

(71) Applicant: ETA SA Manufacture Horlogere Suisse, Grenchen (CH)

(72) Inventors: Pascal Winkler, St-Blaise (CH); Gianni Di Domenico, Neuchatel (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 217 days.

(21) Appl. No.: 15/785,874

(22) Filed: Oct. 17, 2017

(65) Prior Publication Data

US 2018/0107161 A1 Apr. 19, 2018

(30) Foreign Application Priority Data

Oct. 18, 2016 (EP) ..... 16194289

(51) Int. Cl.
*G04B 17/04* (2006.01)
*G04B 15/00* (2006.01)
(Continued)

(52) U.S. Cl.
CPC ..... *G04B 17/04* (2013.01); *G04B 15/00* (2013.01); *G04B 15/02* (2013.01); *G04B 15/14* (2013.01);
(Continued)

(58) Field of Classification Search
CPC ..... G04B 15/00; G04B 15/02; G04B 15/14; G04B 17/04; G04B 17/045; G04B 17/06;
(Continued)

(56) References Cited

U.S. PATENT DOCUMENTS

2016/0216693 A1 7/2016 Hessler et al.
2016/0223989 A1 8/2016 Winkler et al.
(Continued)

FOREIGN PATENT DOCUMENTS

EP 3 054 358 A1 8/2016
FR 577.445 9/1924
FR 2 908 184 A1 8/2015

OTHER PUBLICATIONS

European Search Report dated Apr. 20, 2017 in European Application 16194289.1, filed on Oct. 18, 2016 (with English Translation of Categories of cited documents).

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

Timepiece movement for a mechanical watch, comprising, arranged on a main plate, a resonator mechanism with two degrees of freedom, and a maintaining mechanism subjected to the torque of driving means comprised in the movement, wherein this maintaining mechanism is a continuous maintaining mechanism, and includes a crank movable about a crank rotational axis, and which includes, on the crank rotational axis, an axial element subjected to the torque of driving means, and, off-centre relative to the crank rotational axis, a crankpin which is arranged to travel on a track of a stiff ring comprised in the resonator mechanism, this stiff ring being movable in the two degrees of freedom.

23 Claims, 5 Drawing Sheets

(51) Int. Cl.

| | |
|---|---|
| ***G04B 31/02*** | (2006.01) |
| ***G04C 3/08*** | (2006.01) |
| ***G04B 17/28*** | (2006.01) |
| ***G04B 17/32*** | (2006.01) |
| ***G04B 15/14*** | (2006.01) |
| ***G04B 17/26*** | (2006.01) |
| ***G04B 15/02*** | (2006.01) |
| ***G04B 17/06*** | (2006.01) |

(52) U.S. Cl.
CPC ..... *G04B 17/045* (2013.01); *G04B 17/26* (2013.01); *G04B 17/28* (2013.01); *G04B 17/32* (2013.01); *G04B 31/02* (2013.01); *G04C 3/08* (2013.01); *G04B 17/06* (2013.01)

(58) Field of Classification Search
CPC .... G04B 17/063; G04B 17/066; G04B 17/26; G04B 17/28; G04B 17/32; G04B 31/02; G04C 3/08
See application file for complete search history.

(56) References Cited

U.S. PATENT DOCUMENTS

2016/0246258 A1* 8/2016 Stranczl ..... G04B 17/045
2016/0327909 A1* 11/2016 Henein ..... G04B 15/14

* cited by examiner

MECHANICAL TIMEPIECE MOVEMENT WITH A RESONATOR HAVING TWO DEGREES OF FREEDOM WITH A MAINTAINING MECHANISM USING A RUNNER ROLLING ON A TRACK

This application claims priority from European patent application No. 16194289.1 filed on Oct. 18, 2016, the entire disclosure of which is hereby incorporated herein by reference.

FIELD OF THE INVENTION

The invention concerns a timepiece movement for a mechanical watch, comprising, arranged on a main plate, a resonator mechanism and a maintaining mechanism subjected to the torque of driving means comprised in said movement, The invention also concerns a mechanical watch including at least one such movement.

The invention concerns the field of resonator mechanisms forming the time bases of mechanical watches.

BACKGROUND OF THE INVENTION

Most current mechanical watches include a balance/balance spring type resonator, which forms the time base of the watch, and an escapement mechanism, generally a Swiss lever escapement, which fulfils two main functions:

maintaining the back-and-forth motions of the resonator;

counting these back and forth motions.

The escapement must be robust, resist shocks, and be devised to avoid jamming the movement (overbanking).

A mechanical resonator combines at least one inertial element and one elastic return element. In the sprung-balance, the balance spring acts as the elastic return element for the inertial element formed by the balance.

The balance is conventionally guided in rotation by pivots which rotate in smooth ruby bearings. This produces friction, and therefore energy losses and disturbances in operation, which it is sought to remove. The losses are characterized by the quality factor, Q. It is sought to maximise the Q factor.

The Swiss lever escapement has low energy efficiency (around 30%). This low efficiency is due to the fact that the escapement motions are jerky, there are "drops" (runs to the banking to accommodate machining errors) and also because several components transmit their motion via inclined planes which rub against one another.

EP Patent Application 2908189 in the name of ETA Manufacture Horlogère Suisse discloses a mechanism for synchronizing two timepiece oscillators with a gear train, wherein a timepiece regulating mechanism comprises, mounted to move in at least a pivoting motion with respect to a plate, an escape wheel arranged to receive a drive torque via a gear train, and a first oscillator comprising a first rigid structure connected to the plate by first elastic return means. This regulating mechanism includes a second oscillator, which comprises a second rigid structure, which is connected to the first rigid structure by second elastic return means, and which includes bearing means arranged to cooperate with complementary bearing means comprised in the escape wheel, synchronizing the first oscillator and the second oscillator with the gear train.

EP Patent Application 3054358 in the name of ETA Manufacture Horlogère Suisse discloses a timepiece oscillator, which includes a structure and distinct primary resonators, which are temporally and geometrically shifted, each comprising a weight returned towards the structure by an elastic return means. This timepiece oscillator includes coupling means for the interaction between the primary resonators, including driving means for driving in motion a wheel set which includes driving and bearing means arranged to drive and guide a control means articulated to transmission means each articulated, at a distance from the control means, to a weight of a primary resonator, and the primary resonators and the wheel set are arranged such that the articulation axes of any two of the primary resonators and the articulation axis of the control means are never coplanar.

SUMMARY OF THE INVENTION

It is an object of the present invention to remove the jerkiness of the maintaining mechanism of a resonator, notably an escapement mechanism, in order to increase the efficiency of this maintaining mechanism.

To achieve this object, there is proposed a mechanism allowing continuous interactions, and therefore without jerks, between the resonator and maintaining wheel set, notably an escape wheel. To achieve this, the resonator must be allowed the use of a second degree of freedom, wherein the second degree of freedom is out of phase with respect to the first.

Thus the invention concerns a timepiece mechanism according to claim 1.

The invention also concerns a mechanical watch including at least one such movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
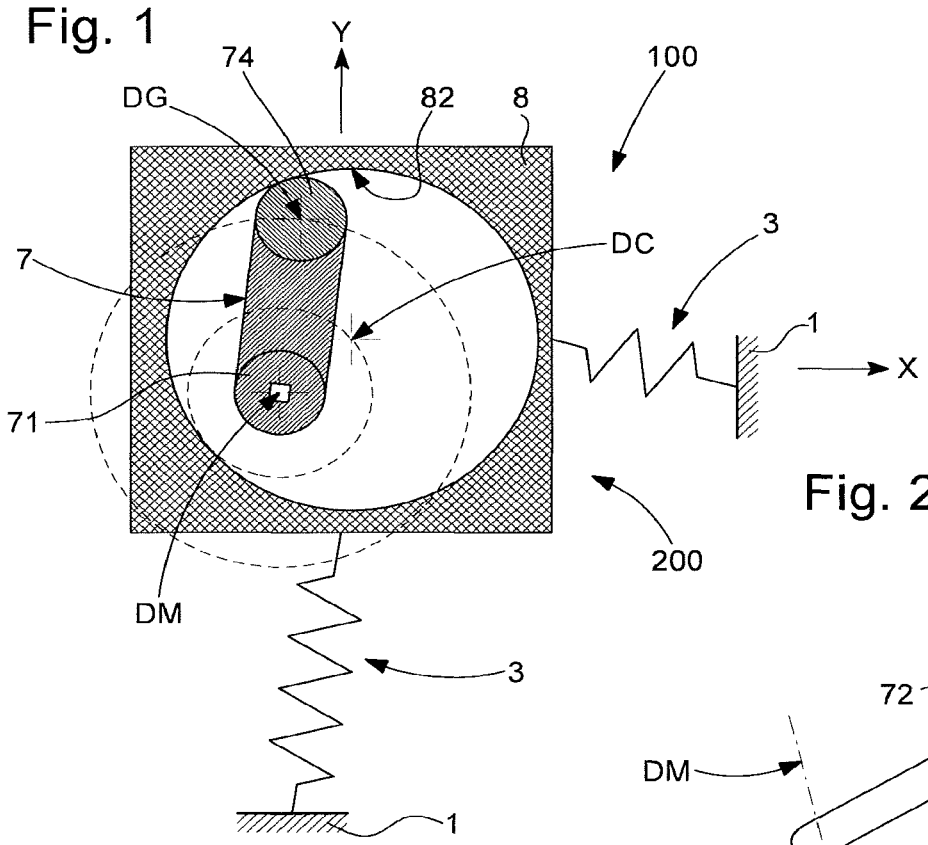
FIG. 1 represents a schematic, partial, plan view of a movement according to the invention, comprising a resonator with two degrees of freedom, and a continuous maintaining mechanism according to the invention, in an in-plane variant wherein the maintaining mechanism includes a crank driven by driving means or a barrel (not represented), carrying an off-centre crankpin which rolls on a track, here a bore, of a ring integral with the inertial element of the resonator.
Figure 2:
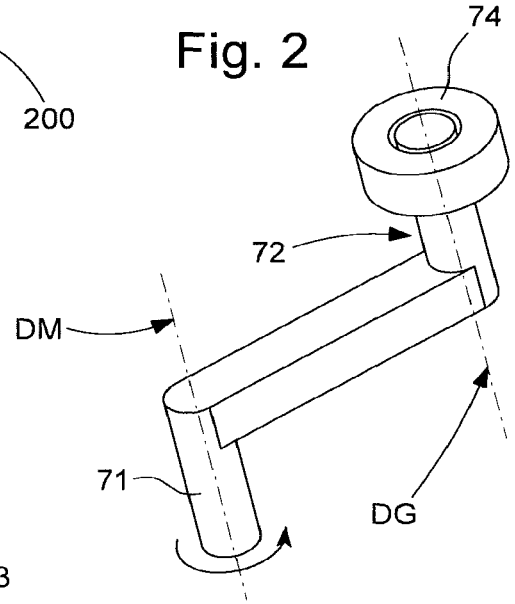
FIG. 2 represents a schematic, perspective view of a particular crank variant carrying a runner in free rotation on its off-centre crankpin.

The invention concerns a mechanical watch 1000, which is provided with a movement 500 that includes, mounted on a main plate 1, a resonator 100 with two degrees of freedom, a first degree of freedom DDL1 and a second degree of freedom DDL2, and a maintaining mechanism 200, subjected to the torque of driving means 300 comprised in movement 500.

According to the invention, and as seen in particular in FIG. 1, this maintaining mechanism 200 is a continuous maintaining mechanism, and includes a crank 7 movable about a crank rotational axis DM, and which includes, on crank rotational axis DM, an axial element 71 subjected to the torque of driving means 300, notably on an escape pinion 4 or similar. Crank 7 includes a crankpin 72, which is off-centre relative to the crank rotational axis DM. This crankpin 72 is arranged to travel along a track 82 of a stiff ring 8 comprised in resonator mechanism 100.

This stiff ring 8 is movable in the two degrees of freedom.

More particularly, ring 8 is movable in a plane P defined by the two degrees of freedom.

More particularly, this stiff ring 8 is subjected to the action of elastic return means 3 in the two degrees of freedom.

More particularly, in an "in-plane" variant, seen in FIGS. 1, 3, 4 and 7, track 82 is of revolution about a contour axis DC perpendicular to plane P.

More particularly, track 82 is cylindrical.

Figure 4:
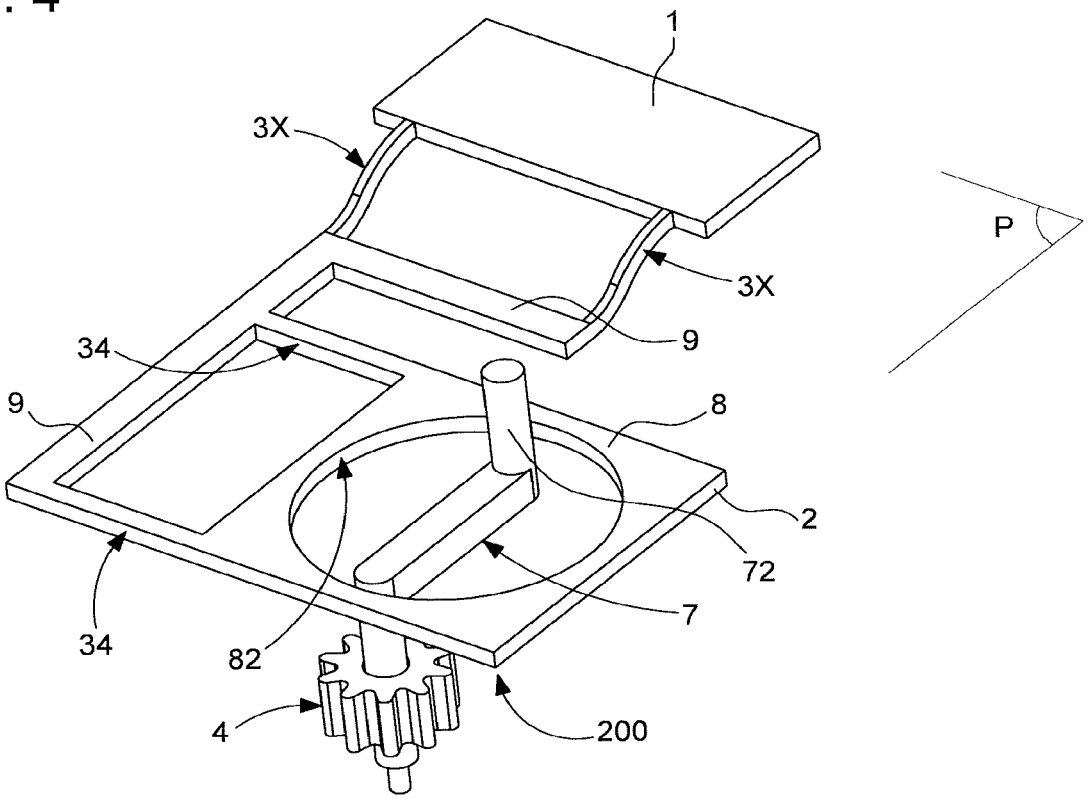
FIG. 4 represents a schematic, perspective view of a particular variant of a resonator with flexible strips, in the case where the two degrees of freedom define a movement in the plane of the inertial element of the resonator.

FIG. 4 illustrates one such in-plane variant, wherein an inertial element 2, carrying ring 8, is suspended by two flexible strips 3Y, parallel to an intermediate part 9, which is suspended, by two flexible strips 3X parallel to each other but perpendicular to strips 3Y, to plate 1.

Figure 6:
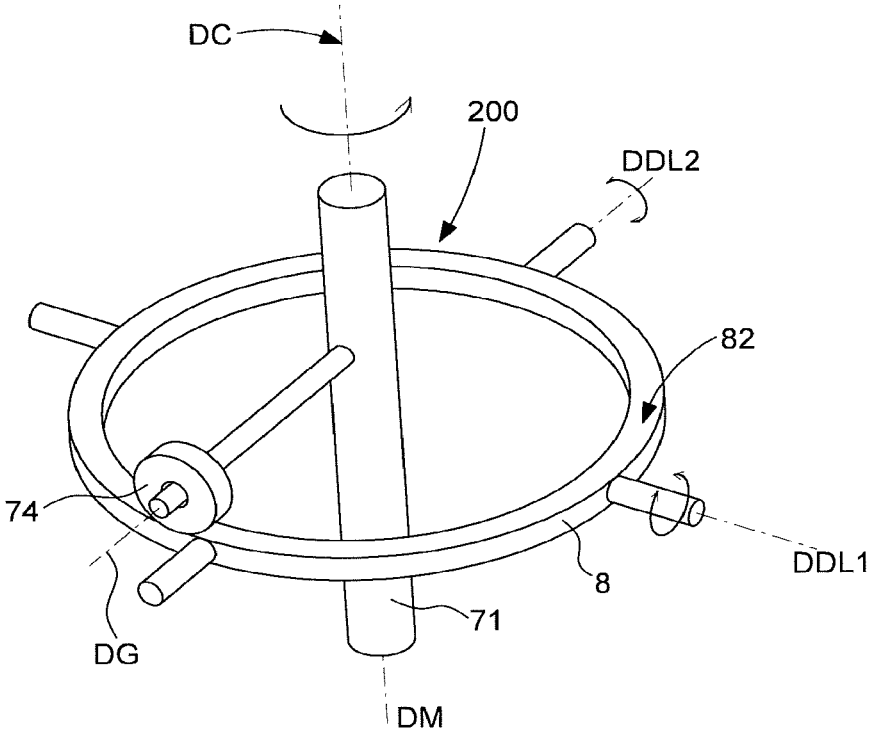
FIG. 6 represents a schematic, perspective view of a particular "out-of-plane" variant, wherein the crankpin rolls tangentially on the track which is flat, and no longer cylindrical as in FIGS. 1, 3 and 4.

In an "out-of-plane" variant seen in FIG. 6, track 82 is flat.

More particularly, the crank's axis rotation DM is perpendicular to plane P.

More particularly, in the in-plane variant, crankpin 72 has a symmetry of revolution about a crankpin axis DG perpendicular to plane P.

More particularly, in the out-of-plane variant, crankpin 72 has a symmetry of revolution about a crankpin axis DG parallel to plane P.

Advantageously, for minimum friction, crankpin 72 includes a runner 74 of revolution about crankpin axis DG, and turning freely about crankpin axis DG, and whose edge travels along track 82.

More particularly, the part of crankpin 72 that travels on track 82 is made of ruby.

Figure 3:
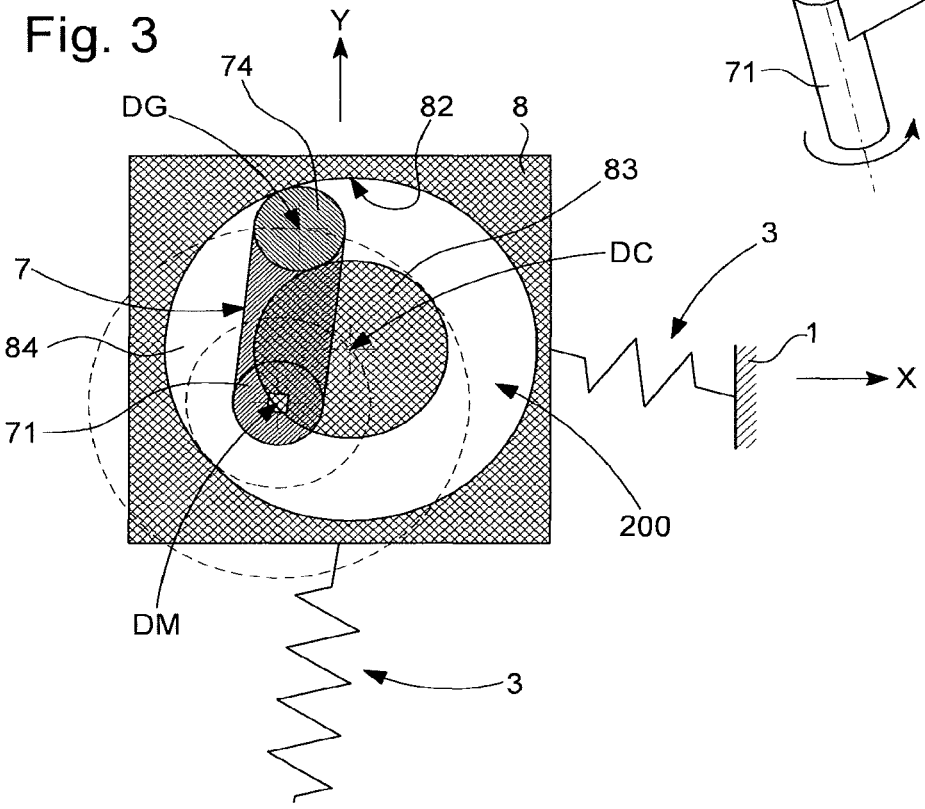
FIG. 3 represents, in a similar manner to FIG. 1, wherein the trajectory of the crankpin is limited to a groove extending between the bore of the ring and a concentric hub, also comprised in the ring.

In the variant of FIG. 3, track 82 is an inner track of stiff ring 8, which includes, inside and at a distance from contour 82, a hub 83 which defines with track 82, a groove 84 inside which crankpin 72 moves, groove 84 forming a safety device preventing any disconnection between crank 7 and resonator 100 in the event of a shock, or in the event of a phase shift between the two degrees of freedom of resonator 100.

More particularly, track 82 and hub 83 are concentric.

Figure 5:
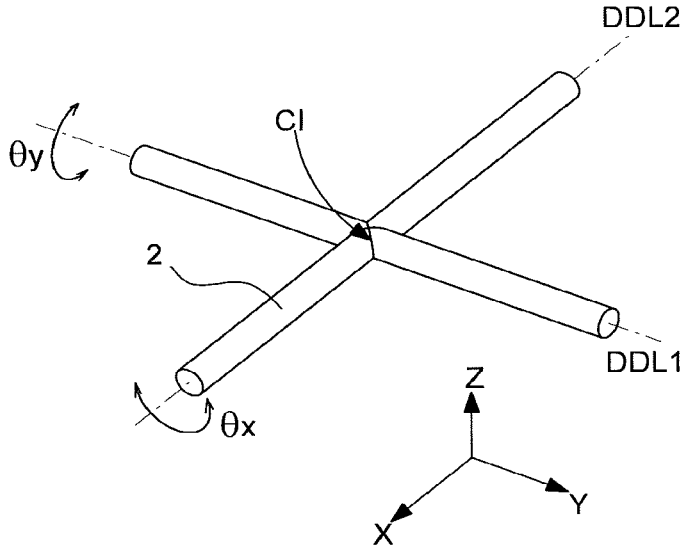
FIG. 5 represents a schematic, perspective view of the case where the two degrees of freedom are rotations about the centre of inertia of the inertial element of the resonator.

In the particular case of FIG. 5, the two degrees of freedom of resonator mechanism 100 are rotations about the centre of inertia CI of an inertial element 2 of resonator 100 including ring 8.

In a particular and advantageous variant, the period of oscillation of resonator mechanism 100 in the first degree of freedom DDL1 and the period of oscillation of resonator mechanism 100 in the second degree of freedom DDL2 are substantially identical. More particularly, these periods are equal.

In a particular variant that is not illustrated, resonator mechanism 100 includes an inertial element 2 comprising ring 8, the inertial element including inertia blocks for adjusting inertia and unbalance.

In a particular variant, resonator mechanism 100 includes a single inertial element 2, rigidly connected to ring 8, or formed by ring 8.

Figure 7:
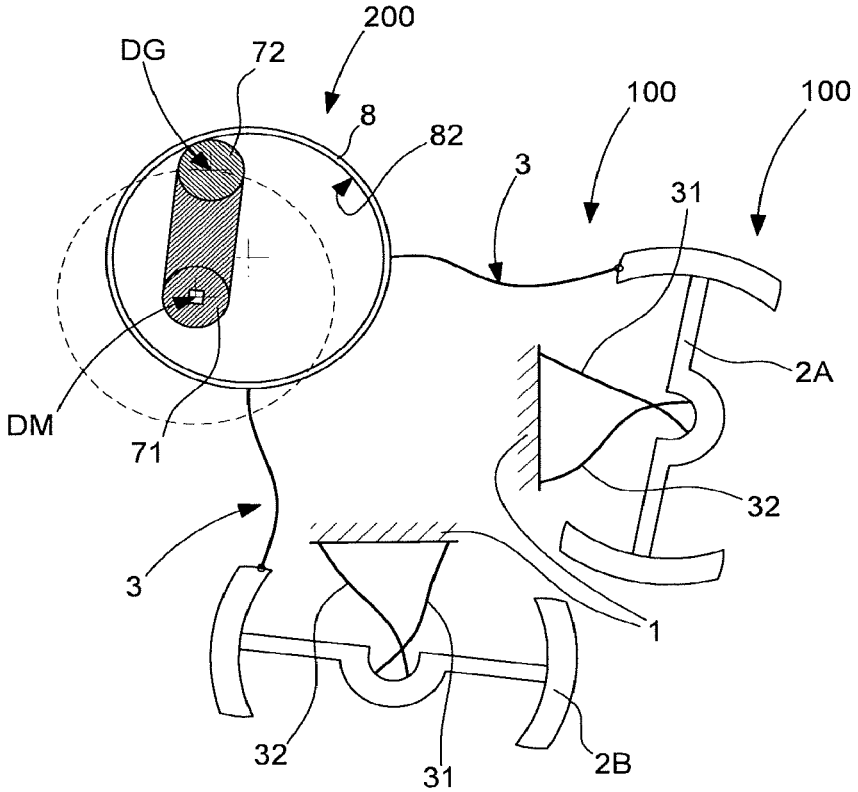
FIG. 7 represents a schematic, partial, plan view of a movement according to the invention, wherein the resonator includes two inertial elements, oscillating with a temporal phase shift of a quarter-period, each connected to the ring of FIG. 1 in a flexible manner in the direction perpendicular to its motion; each inertial element is connected to the movement plate by two crossed strips.

In a particular variant illustrated by FIG. 7, resonator mechanism 100 includes two inertial elements 2A, 2B, oscillating with a temporal phase shift of a quarter-period, and each connected to ring 8 in a flexible manner, in a direction perpendicular to that about which the inertial element 2A, 2B concerned oscillates.

More particularly, each inertial element 2A, 2B is connected to plate 1 by means of a flexible bearing with crossed strips 31, 32 defining a virtual axis of rotation passing through the centre of inertia CI of the inertial element 2A, 2B concerned.

In a variant, resonator mechanism 100 with two degrees of freedom is a resonator with flexible bearings, comprising flexible strips arranged to guide at least one inertial element 2 of resonator 100 and/or ring 8, and to ensure the elastic return of this inertial element 2 and/or of this ring 8.

In a particular variant, the flexible strips are made of "elinvar".

In a particular variant, the flexible strips are made of oxidised silicon to compensate for the effects of temperature.

Advantageously, and as illustrated by the Figures, the elastic return means are formed by rotating flexible bearings devoid of pivots.

In a particular implementation of the invention, the elastic return means all together form a monolithic component.

In a particular embodiment of the invention, illustrated by the Figures, the elastic return means include flexible bearings with two strips, which are either crossed in the same plane, or strips located in two close, parallel planes and whose projections intersect in a parallel plane.

In this variant of a flexible bearing with two strips, the point of real or projected intersection of the two strips is advantageously situated at a point located between 0.12 and 0.14 times their length, and these strips form between them an angle comprised between 60 and 80 degrees.

Figure 8:
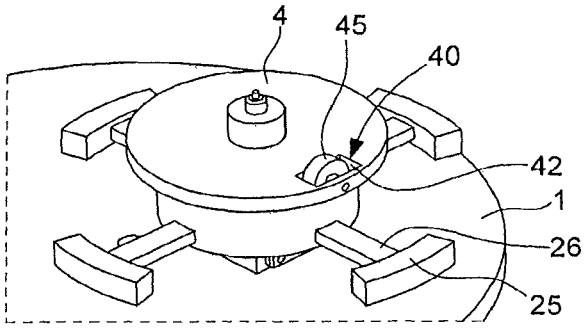
FIGS. 8 and 9 illustrate, in a schematic, perspective view, a movement according to another variant of the invention, also comprising bearing means combined with elastic return means, respectively assembled in FIG. 8 and in an exploded view in FIG. 9, wherein a plate carries, by means of elastic connections with crossed flexible strips, a substantially cross-shaped inertial element comprising an upper annular track, on which rolls a runner, housed inside a notch of a maintaining wheel set, which is pivoted in a housing of the plate and in a bar (not represented), wherein this runner exerts an off-centre thrust force on the inertial element, subjecting the latter to a precession rotational motion.
Figure 9:
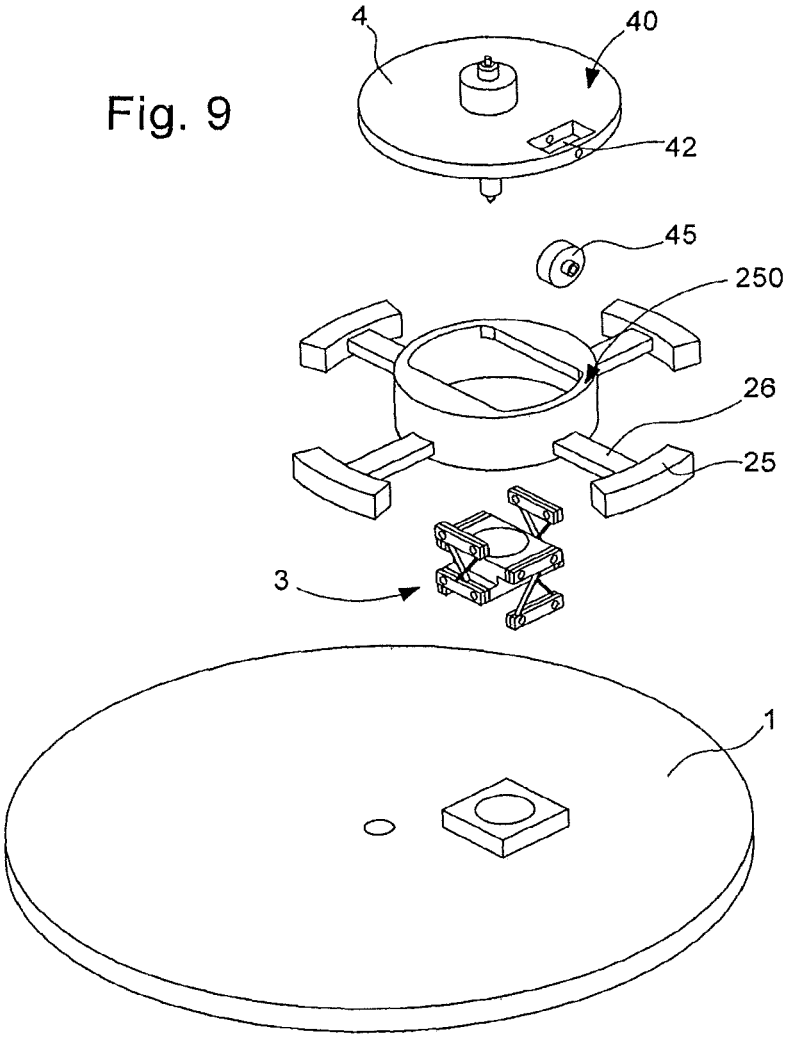

In a variant illustrated in FIG. 8, maintaining mechanism 200 includes driving means 40 with a hole 42 arranged for guiding a runner 45. This runner 45 is arranged to roll on an annular track 250 comprised in inertial element 2, said track 250 forms the complementary continuous driving means 20. Runner 45 thus imparts an off-centre force to the inertial element, and a torque, which tends to impart to inertial element 2 a precessional motion, like a coin or a plate spun on a plane surface due to a torque, or like a gyroscope or spinning top. The continuous maintaining mechanism is then formed of a ring carrying annular track 250 and integral with inertial element 2, driven in a precessional motion by wheel 4 with runner 45, subjected to the torque of driving means 300, notably of at least one barrel, wherein wheel 4 rotates about an axis perpendicular to the plane defined by the axes of rotation of the two flexible rotations.

The invention also concerns a timepiece, particularly a mechanical watch 1000, including one such movement 500.

Figure 10:
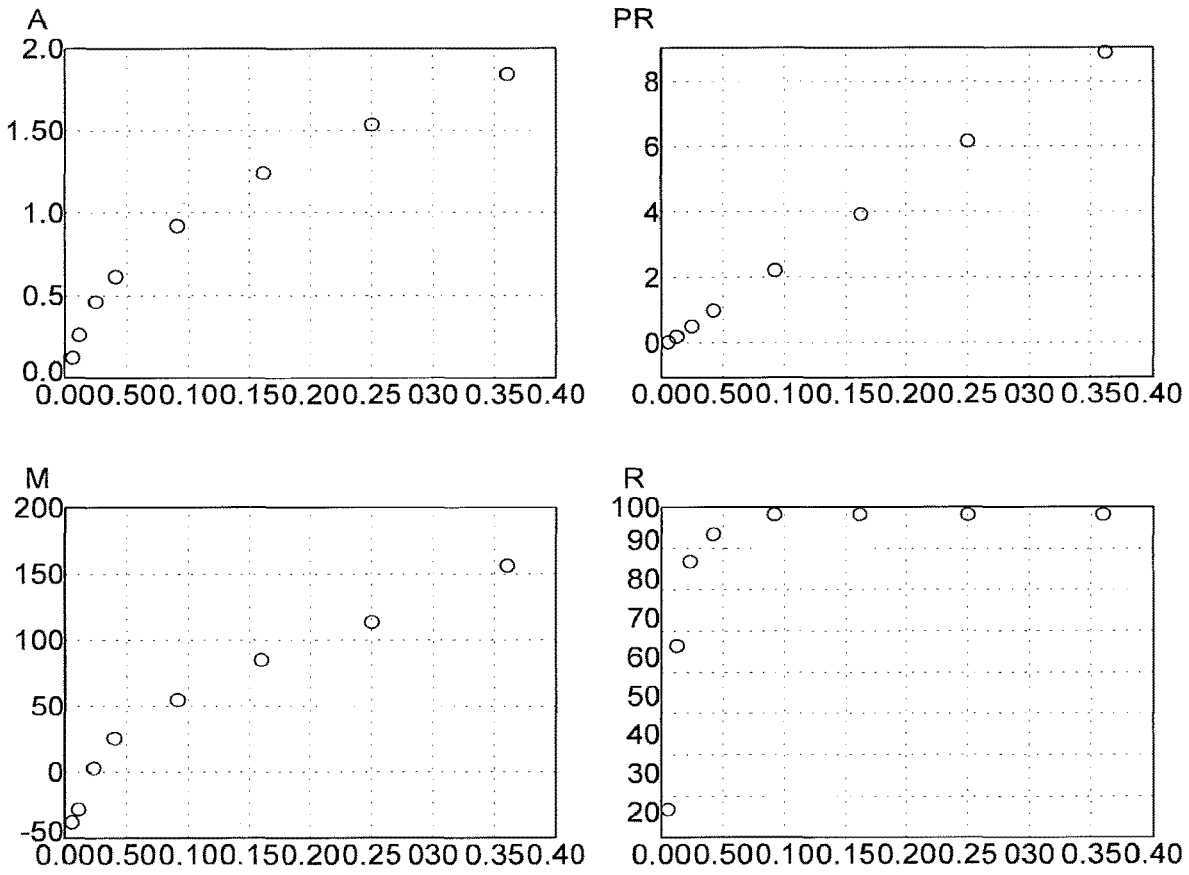
FIG. 10 sets out experimental measurements, which are diagrams presenting, as a function of torque on the abscissa: the amplitude A; regulating power PR, rate M, and efficiency R.
Figure 11:
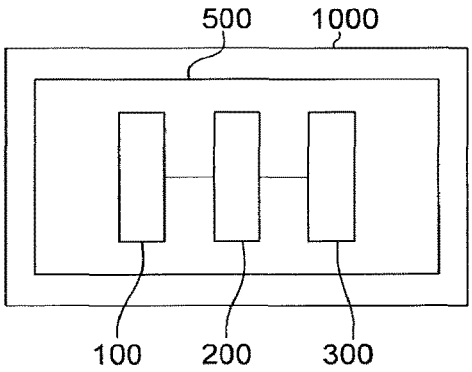
FIG. 11 is a block diagram representing a watch including such a movement.

FIG. 10 shows experimental measurements, in the form of diagrams presenting, as a function of torque on the abscissa, in microNm: the amplitude in mm A; the regulating power in mW PR, the rate in seconds per day M, and the efficiency in % R. It is seen that the system functions over a vast range of torque and that efficiency is close to 98%. The loss due to this escapement system depends to quite a large extent on torque, which may be off-set by non-linearity in the return springs.

In short, the present invention offers particular advantages:

- eliminating pivot friction from the resonator, by replacing the pivots with flexible bearings, making it possible to increase the quality factor;
- eliminating jerks from the maintaining mechanism, through continuous maintenance, making it possible to increase the efficiency of the maintaining mechanism, notably the efficiency of the escapement when the maintaining mechanism is an escapement mechanism.

What is claimed is:

1. A timepiece movement for a mechanical watch comprising, arranged on a main plate, a resonator mechanism with two degrees of freedom, and a maintaining mechanism subjected to torque of driving means comprised in said movement, wherein said maintaining mechanism is a continuous maintaining mechanism, and includes a crank movable about a crank rotational axis and which includes, on said crank rotational axis, an axial element subjected to the torque of said driving means, and off-centre relative to said crank rotational axis, a crankpin which is arranged to travel on a track of a stiff ring comprised in said resonator mechanism, said stiff ring being movable in said two degrees of freedom.

2. The movement according to claim 1, wherein said stiff ring is subjected to action of elastic return means.

3. The movement according to claim 1, wherein said stiff ring is movable in a plane.

4. The movement according to claim 3, wherein said track is of revolution about a contour axis perpendicular to said plane.

5. The movement according to claim 4, wherein said track is cylindrical.

6. The movement according to claim 5, wherein said track is an inner track of said stiff ring, which includes, inside and at a distance from said track, a hub which defines with said track, a groove inside which said crankpin moves, said groove forming a safety device preventing any disconnection between said crank and said resonator in the event of a shock, or in the event of a phase shift between said two degrees of freedom of said resonator, and in that said track and said hub are concentric.

7. The movement according to claim 4, wherein said track is flat.

8. The movement according to claim 3, wherein said crank rotational axis is perpendicular to said plane.

9. The movement according to claim 3, wherein said crankpin has a symmetry of revolution about a crankpin axis perpendicular to said plane.

10. The movement according to claim 3, wherein said crankpin has a symmetry of revolution about a crankpin axis parallel to said plane.

11. The movement according to claim 9, wherein said crankpin includes a runner of revolution about said crankpin axis and rotating freely about said crankpin axis, and whose edge travels along said track.

12. The movement according to claim 1, wherein a portion of said crankpin that travels on said track is made of ruby.

13. The movement according to claim 1, wherein said track is an inner track of said stiff ring, which comprises, inside and at a distance from said track, a hub which defines with said track, a groove inside which said crankpin moves, said groove forming a safety device preventing any disconnection between said crank and said resonator mechanism in the event of a shock, or in the event of a phase shift between said two degrees of freedom of said resonator mechanism.

14. The movement according to claim 1, wherein said two degrees of freedom of said resonator mechanism are rotations about the centre of inertia of an inertial element of said resonator (100) including said ring.

15. The movement according to claim 1, wherein the period of oscillation of said resonator mechanism in the first degree of freedom and the period of oscillation of said resonator mechanism in the second degree of freedom are substantially identical.

16. The movement according to claim 1, wherein said resonator mechanism includes an inertial element including said stiff ring, said inertial element including inertia blocks for adjusting inertia and unbalance.

17. The movement according to claim 1, wherein said resonator mechanism includes a single inertial element rigidly connected to said stiff ring.

18. The movement according to claim 1, wherein said resonator mechanism includes two inertial elements oscillating with a temporal phase shift of a quarter-period, and each connected to said stiff ring in a flexible manner in a direction perpendicular to that about which said inertial element concerned oscillates.

19. The movement according to claim 18, wherein each said inertial element is connected to said main plate by means of a flexible bearing with crossed strips defining a virtual axis of rotation passing through the centre of inertia of said inertial element concerned.

20. The movement according to claim 1, wherein said resonator mechanism with said two degrees of freedom is a resonator with flexible bearings, comprising flexible strips arranged to guide at least one inertial element of said resonator and/or said stiff ring, and to ensure elastic return of said inertial element and/or of said stiff ring.

21. The movement according to claim 20, wherein said flexible strips are made of elinvar.

22. The movement according to claim 20, wherein said flexible strips are made of oxidised silicon to compensate for the effects of temperature.

23. A mechanical watch including at least one movement according to claim 1.

* * * * *